US006422223B2

(12) United States Patent
Meilinger et al.

(10) Patent No.: US 6,422,223 B2
(45) Date of Patent: Jul. 23, 2002

(54) ELECTROMECHANICALLY ACTUATED SOLENOID EXHAUST GAS RECIRCULATION VALVE

(75) Inventors: Robert Meilinger, Beverly Hills; Cathleen Grace Rutsey, Ferndale; Muhammad Malik, Wixom, all of MI (US)

(73) Assignee: BorgWarner, Inc., Troy, MI (US)

( * ) Notice: Subject to any disclaimer, the term of this patent is extended or adjusted under 35 U.S.C. 154(b) by 0 days.

(21) Appl. No.: 09/784,617

(22) Filed: Feb. 15, 2001

Related U.S. Application Data

(63) Continuation-in-part of application No. 09/610,805, filed on Jul. 6, 2000, which is a continuation-in-part of application No. 09/266,650, filed on Mar. 11, 1999, now Pat. No. 6,182,646.

(51) Int. Cl.[7] ..... F02M 25/07; F02B 47/08; H01F 7/00

(52) U.S. Cl. ..... 123/568.21; 335/219

(58) Field of Search ..... 123/568.21, 568.26; 251/129.15; 335/219, 224, 255, 261, 262, 270, 271, 272, 279

(56) References Cited

U.S. PATENT DOCUMENTS

| | | | | |
|---|---|---|---|---|
| 4,378,777 A | | 4/1983 | Iida et al. | |
| 4,662,604 A | | 5/1987 | Cook | |
| 4,796,854 A | | 1/1989 | Ewing | |
| 4,858,886 A | | 8/1989 | Tatara | |
| 5,027,781 A | | 7/1991 | Lewis | |
| 5,188,073 A | | 2/1993 | Eiiri et al. | |
| 5,255,659 A | | 10/1993 | Choma | |
| 5,435,519 A | | 7/1995 | Everingham | |
| 5,460,146 A | | 10/1995 | Frankenberg | |
| 5,467,962 A | | 11/1995 | Bircann et al. | |
| 5,494,255 A | | 2/1996 | Pearson et al. | |
| 5,577,484 A | | 11/1996 | Izutani et al. | |
| 5,593,132 A | | 1/1997 | Hrytzak | |
| 5,687,698 A | * | 11/1997 | Mastro et al. | 123/568.26 |
| 5,779,220 A | * | 7/1998 | Nehl et al. | 123/568.26 |
| 5,901,940 A | | 5/1999 | Hussev et al. | |
| 5,911,401 A | | 6/1999 | Hrytzak et al. | |
| 5,957,117 A | | 9/1999 | Everingham | |
| 5,960,776 A | | 10/1999 | Everingham et al. | |
| 5,975,064 A | | 11/1999 | Krimmer | |
| 5,988,147 A | | 11/1999 | Everingham | |
| 6,053,473 A | | 4/2000 | Shinobu et al. | |

FOREIGN PATENT DOCUMENTS

| | | |
|---|---|---|
| EP | 0 428 274 A1 | 5/1991 |
| EP | 0 900 931 A3 | 10/1999 |
| EP | 0 900 931 A2 | 10/1999 |

* cited by examiner

*Primary Examiner*—Willis R. Wolfe
*Assistant Examiner*—Arnold Castro
(74) *Attorney, Agent, or Firm*—Artz & Artz, P.C.; Greg Dziegielewski

(57) ABSTRACT

An exhaust gas recirculation valve (10) for an engine including a valve housing (14), a motor housing (12), and a sensor housing (16). The motor housing (12) has an armature (30) disposed therein that is movable to cause a valve (10) to move in relation to a valve seat (120). The outer periphery of the armature (30) is in contact with an armature bearing (66). The armature bearing (66) has an upper portion (68) in communication with a flux return (46) and a lower portion (70) in communication with a pole piece (56). One of either the flux return (46) or the pole piece (56) is located so as to reduce an air gap (200) therebetween.

8 Claims, 4 Drawing Sheets

ELECTROMECHANICALLY ACTUATED SOLENOID EXHAUST GAS RECIRCULATION VALVE

CROSS REFERENCE TO RELATED APPLICATIONS

This is a continuation-in-part of U.S. patent application Ser. No. 09/610,805, filed on Jul. 6, 2000, still pending, which is a continuation-in-part of U.S. application Ser. No. 09/266,650 filed on Mar. 11, 1999, now U.S. Oat. No. 6,182,646.

TECHNICAL FIELD

The present invention relates generally to a solenoid operated exhaust gas recirculation valve, and more specifically, to a solenoid operated exhaust gas recirculation valve that is smaller than prior valves and eliminates any valve dithering.

BACKGROUND OF THE PRESENT INVENTION

Exhaust gas recirculation ("EGR") valves form an integral part of the exhaust gas emissions control in typical internal combustion engines. EGR valves are utilized to recirculate a predetermined amount of exhaust gas back to the intake system of the engine. The amount of exhaust gas permitted to flow back to the intake system is usually controlled in an open-looped fashion by controlling the flow area of the valve, i.e., the amount of exhaust gas that is permitted to flow through the valve. Such open-loop control makes it difficult to accurately control the exhaust gas flow through the valve over the valve's useful life. This is because the valve has various components that can wear. Moreover, vacuum signals which are communicated to such valves will vary or fluctuate over time resulting in the potential contamination of various valve components which could affect the operation of the valve.

Many EGR valves utilize a moveable diaphragm to open and close the valves. However, these valves can lack precision because of the loss of vacuum due to external leak-paths. To overcome the lack of consistently available vacuum to control a movable diaphragm, electrically actuated solenoids have been used to replace the vacuum actuated diaphragm. Moreover, typical vacuum actuated valves can also have problems with accuracy due to their inability to quickly respond based on changes in engine operating conditions. Further, current EGR valves typically have an inwardly opening valve closure element that is moved into its valve housing relative to a cooperating valve seat in order to open the valve. Over the useful life of these valves, carbon can accumulate on the valve closure element and upon its valve seat, thereby preventing the valve from completely closing. The valve closure elements are also positioned within the housing or body of these EGR valves and because it is virtually impossible to clean the valve closure element and the valve seat, contamination thereby necessitates replacement of these integral pollution system components.

Additionally, exhaust gas recirculation valves that require a high force to open the valve, operate through pressure balancing, whether through a diaphragm or other balancing members. Alternatively, too low a force can open the valve allowing exhaust gas to flow through the valve opening when such exhaust gas is not needed. By allowing exhaust gas to act as part of the pressure balance, it necessarily contacts the internal moving parts of the valve causing contaminants to accumulate thereon which can interfere with the proper operation of the valve, as discussed above.

As is known, in these current solenoid actuated EGR valves, flux travels through a path from the flux washer through the armature and then through the pole piece. The configuration of this magnetic circuit works effectively to control movement of the armature and thus the location of the valve in the valve seat. However, in the desire to produce smaller valves, engine pulses can cause dithering, i.e. movement of the valve with respect to the valve seat. This can cause inefficiencies as well as other problems.

Therefore, a need arises for a smaller EGR valve that minimizes any valve dithering.

SUMMARY OF THE INVENTION

It is, therefore, an object of the present invention to provide an improved electromechanically actuated EGR valve that is used to meter and control the passage of exhaust gases from an exhaust passage to the intake system of an internal combustion engine.

It is another object of the present invention to provide an electromechanically actuated EGR valve that helps reduce an engine's emissions of environmentally unfriendly elements.

It is a further object of the present invention to provide a solenoid operated EGR valve that minimizes valve dithering.

It is still a further object of the present invention to provide a solenoid operated EGR valve that induces electromagnetic damping.

In accordance with the above and other objects of the present invention, a solenoid actuated EGR valve for an engine is disclosed. The EGR valve includes a valve housing and a motor housing. The valve housing includes a valve inlet adapted to receive exhaust gas and a valve outlet adapted to communicate the received exhaust gas to an intake manifold of the engine. The motor housing is positioned above the valve housing and has an electromagnetic mechanism disposed therein, which includes a plurality of wire windings, a bobbin, an armature, and a valve stem in communication with the armature. The armature is moved due to increased current that creates electromagnetic forces created in the magnetic circuit which moves the valve stem with respect to a valve seat that is located in the valve housing around the periphery of a valve opening. A plunger extends from a sensor housing positioned above the motor housing to monitor the position of the valve stem. A guide bearing is disposed within the motor housing and is in communication with the armature to help position the armature concentrically within the magnetic circuit. The guide bearing is in communication at an upper portion with a flux washer and at a lower portion with a pole piece. The guide bearing is sized so that any radial air gap between the flux washer and the pole piece is reduced to cause at least some amount of shorting therebetween.

These and other features and advantages of the present invention will become apparent from the following descriptions of the invention, when viewed in accordance with the accompanying drawings and appended claims.

BEST MODE(S) FOR CARRYING OUT THE INVENTION

Figure 1:
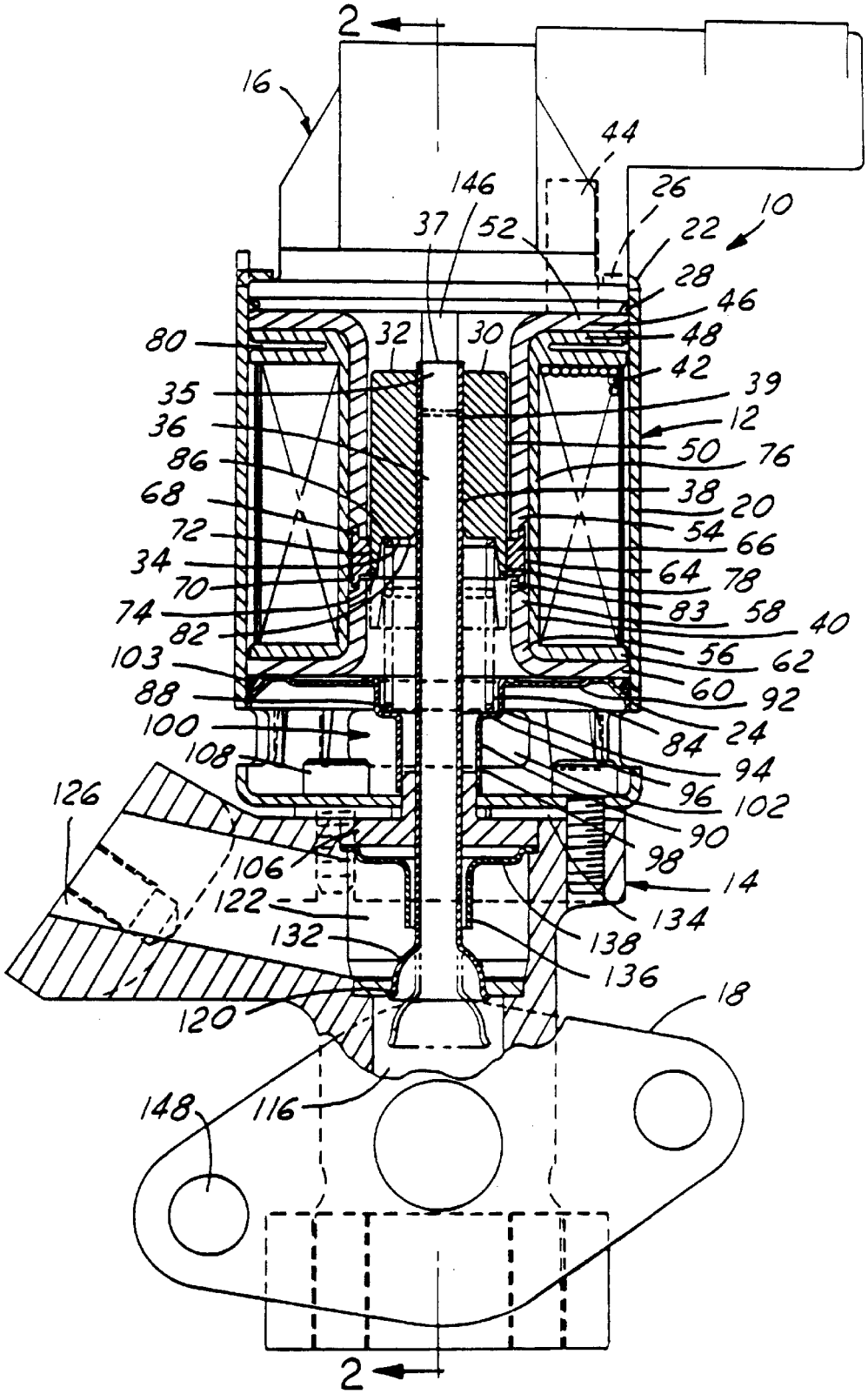
FIG. 1 is a cross-sectional view of an exhaust gas recirculation valve, including an engine mount, in a closed position in accordance with a preferred embodiment of the present invention.
Figure 2:
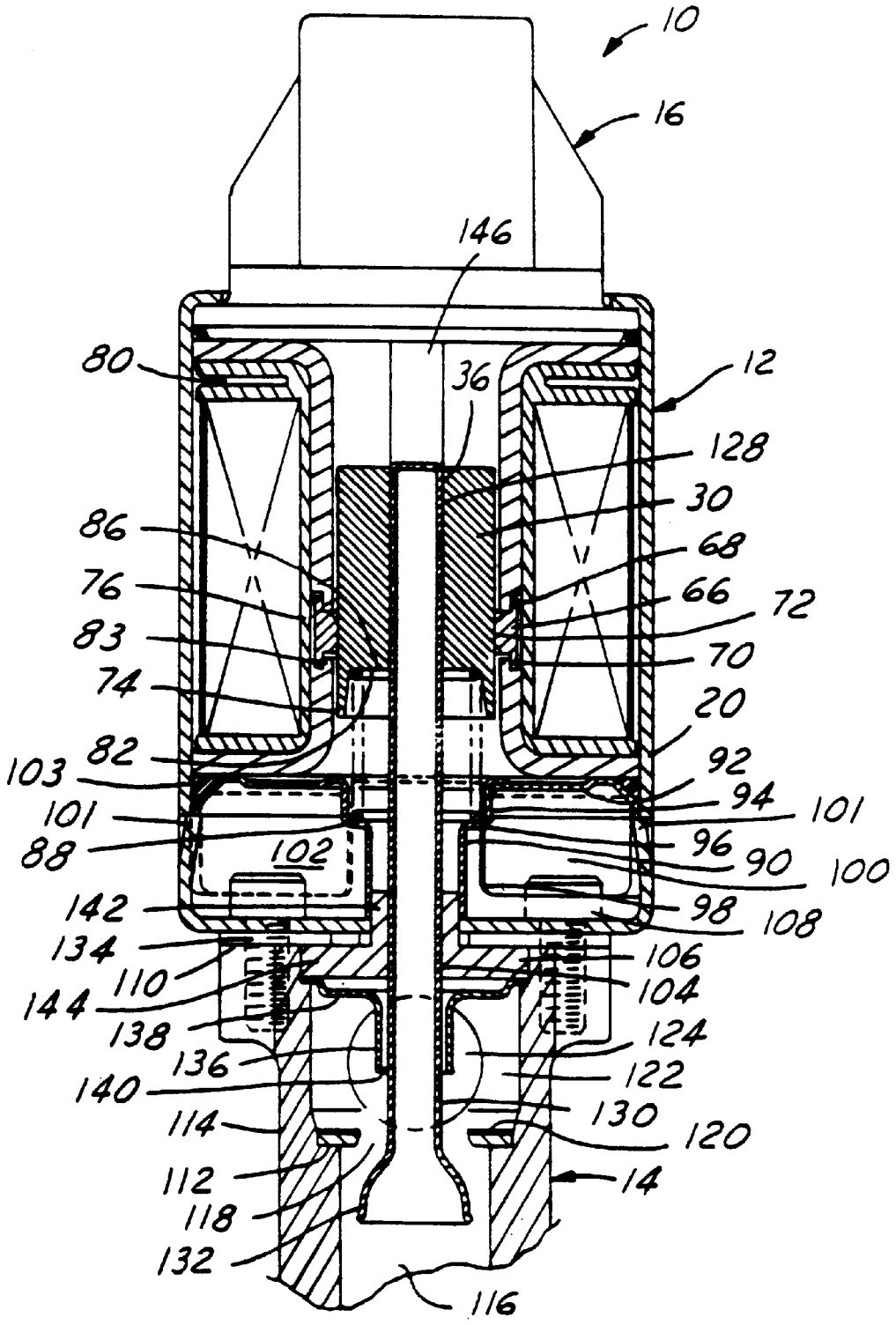
FIG. 2 is a cross-sectional view of the exhaust gas recirculation valve of FIG. 1, along the line 2—2 with the valve in an open position.

FIGS. 1 and 2 illustrate an exhaust gas recirculation ("EGR") valve 10 in accordance with a preferred embodiment of the present invention. The valve 10 is a solenoid actuated EGR valve, having a motor housing 12, a valve housing 14, a sensor housing 16, and an engine mount 18.

The motor housing 12 includes an outer shell 20 having a top portion 22 and a bottom portion 24. The motor housing 12 is preferably comprised of steel, however, any other suitable magnetic material can be utilized. The top portion 22 of the outer shell 20 has an upper peripheral portion 26 that is bent or otherwise formed so as to extend generally inwardly to crimp the sensor housing 16 to the motor housing 12. An upper seal 28, such as an O-ring or the like, is preferably positioned at the peripheral connection of the sensor housing 16 and the motor housing 12 to seal the motor housing 12 from the atmosphere and eliminate any leak paths. As shown, the upper seal 28 seals three surfaces from external leaks. Additionally, the upper seal 28 will expand upon increased heat, which will minimize any rattle in the valve 10 and provide improved vibration characteristics.

An armature 30 is disposed within the motor housing 12 and has a top surface 32 and a bottom surface 34. The armature 30 preferably has a nickel plated surface to provide hardness, durability, and low friction. The armature 30 may also have other coatings that provide similar characteristics, such as chrome. The armature 30 preferably has a hollow pintel valve 35 positioned within a bore 38 formed in the center of the armature 30. The hollow pintel valve configuration allows for the low transmission of heat to the coil and armature and also improves gas flow, such as when in the position shown in FIG. 3. The valve stem 36 has a closed upper end 37 that is secured within the bore 38 and may extend above the top surface 32 of the armature 30. The hollow valve 36 may be attached to the bore 38 in any of a variety of ways. Moreover, the closed upper end 37 of the hollow valve 36 may also be positioned such that its top surface terminates below the top surface 32 of the armature 30. A valve stem 36, which is preferably also hollow to reduce the weight of the part is preferably press fit into the bore 38 formed in the center of the armature 30. This configuration allows the effective length of the valve stem 36 to be changed by how far it is inserted into the armature bore 38, as is discussed in more detail below. The connection or assembly of the valve stem 36 is less costly and provides a more accurately formed valve as the length of the valve stem is not dependent upon precise tolerances as any excess length valve stem 36 can be accommodated for by the armature bore 38.

A bobbin 40 holds a plurality of wire windings 42 in the motor housing 12. The bobbin 40 encapsulates the armature 30 and valve stem 36. The wire windings 42 are excited by current from a contact or terminal 44 that is positioned within the sensor housing 16 and in communication with the wire windings 42 by a wire 45 or the like. The increased current in the windings 42 is used to move the armature 30 downwardly within the motor housing 12, thus moving the valve stem 36 correspondingly downward.

A flux return 46, which is preferably comprised of a magnetic material, is positioned between the upper portion 48 of the bobbin 40 and the outer periphery 50 of the armature 30. The flux return 46 has an upper portion 52 and a lower portion 54. A pole piece 56, having a first portion 58 and a second portion 60, is anularly positioned between the lower portion 62 of the bobbin 40 and the valve stem 36 and axially below the flux return 46. A gap 64 is preferably formed between the first portion 58 of the pole piece 56 and the lower portion 54 of the flux return 46.

An armature bearing 66 is disposed in the motor housing 12 to guide the armature 30 as it travels in response to increased and decreased current in the wire windings 42. The armature bearing 66 is positioned in the gap 64 and has an upper shoulder portion 68 and a lower shoulder portion 70. The upper shoulder portion 68 is overlapped by the lower portion 54 of the flux return 46 while the lower shoulder portion 70 of the armature bearing 66 is overlapped by the first portion 58 of the pole piece 56 such that the armature bearing 66 is securely positioned within the motor housing 12. The armature bearing 66 also has an annular surface 72 which contacts the outer periphery 50 of the armature 30 to guide the armature 30 as it moves linearly within the motor housing 12. The armature bearing 66 also assists in keeping the armature 30 and thus the valve stem 36 accurately and centrally positioned within the motor housing 12. Further, the armature bearing 66 helps keep the pole piece 56 and the flux return 46 concentrically positioned. The armature bearing 66 is preferably bronze, however, any other suitable materials can be utilized. The armature bearing 66 is thus positioned within a magnetic flux path created between the pole piece 56 and the flux return 46.

The bobbin 40 is bounded at its upper portion 48 by the upper portion 52 of the flux return 46. The bobbin 40 is bounded at its middle portion 76 by the lower portion 54 of the flux return 46 and the first portion 58 of the pole piece 56. The bobbin 40 is bounded and at its lower portion 62, by the second portion 60 of the pole piece 56. The bobbin 40 thus separates the inner surfaces of the pole piece 56 and the flux return 46 from the wire windings 42. The bobbin 40 has a groove 80 formed in its upper portion 48 for securely holding the wire 45 to the terminal 44 to provide constant electrical contact between the wire windings 42 and the sensor housing 16 and to allow for the energizing of the wire windings 42.

The armature 30 has a cavity 82 formed in the armature bottom surface 34 which is defined by an armature ear 74 that extends around the periphery of the cavity 82 and contacts the armature bearing 66. The ear 74 is preferably positioned on the armature 30 as opposed to being positioned on the pole piece 56 for controlling the flux path as has been previously done. The armature 30 is positioned within the motor housing 12 such that when the valve is closed, the lowermost portion 78 of the armature ear 74 is aligned in the same plane as the top of the pole piece 56. The configuration of the flux return 46 and the pole piece 56 is such that the inclusion of the gap 64 therebetween minimizes the net radial magnetic forces, by limiting the radial forces on the armature 30 and thus the side loading on the armature bearing 66. The geometry of the armature 30 also provides radial and axial alignment. Additionally, by initially aligning the armature ear 74 with the top of the pole piece 56, the magnetic flux in the motor housing is limited which allows for larger tolerances which in turn decreases the cost to manufacture the valve 10. Additionally, by aligning the initial position of the armature 30 with the top 83 of the pole piece 56, the movement of the armature 30 is limited to its useable range such that the valve 10 may be more accurately controlled.

A biasing spring 84 having an upper surface 86 and a lower surface 88 is disposed within the motor housing 12. The upper surface 86 of the biasing spring 84 is disposed within the cavity 82 and contacts the armature bottom surface 34. The lower surface 88 of the biasing spring 84 contacts a partition member 90 and is supported thereon. The partition member 90 has an upper surface 92, a stepped portion 94, with a shoulder portion 96, and an annular surface 98. The upper surface 92 preferably runs generally parallel with and contacts the second portion 60 of the pole piece 56 to provide support thereto. The lower surface 88 of the biasing spring 84 rests on the shoulder portion 96 of the partition member 90 while the annular surface 98 extends generally downward from the shoulder portion 96 towards the bottom portion 24 of the housing outer shell 20. The biasing spring 84 acts to urge the armature 30 to its initial position, shown in FIG. 1, where the valve 10 is closed. When the valve 10 is opened, due to downward movement of the armature 10, the biasing spring 84 is compressed, as shown in FIG. 2.

An annular cavity 100 is formed in the motor housing 12 and is defined by the partition member 90, the housing outer shell 20, and the bottom portion 24 of the housing outer shell 20. A plurality of vent openings 102 are formed in the housing outer shell 20 of the valve 10 to allow cool air to circulate through the annular cavity 74 to cool the valve stem 36 and other components in the motor housing 12. This arrangement also provides an air gap between the motor housing 12 and the valve housing 14 that will limit the egress of heat from the valve housing 14 to the motor housing 12. The annular cavity 100 may be formed between the motor housing 12 and valve housing 14 with vent openings 102 communicating therewith.

A lower seal 103 is provided at the juncture between the upper surface 92 of the partition member 90, the housing outer shell 20, and the second portion 60 of the pole piece 56 to eliminate any leak path between the annular cavity 100 and the motor housing 12. The lower seal 103 also seals three surfaces from external leaks and provides improved vibration characteristics when the lower seal 103 expands. The lower portion 24 of the can 20 has a plurality of shear tabs 101 formed therein. The shear tabs 101 extend generally inwardly into the annular cavity 100 and support the partition member 90. These shear tabs 101 can be formed in subsequent manufacturing processes allowing for inexpensive one-piece manufacturing of the can 20 without the need for additional material to support the partition member 90. The configuration allows for the inexpensive support of the wire windings 42 and also provides a spring against which the motor housing 12 can be crimped.

The bottom portion 24 of the housing outer shell 20 has a valve stem opening 104 formed therethrough. The valve stem opening 104 is formed in the bottom portion 24 of the outer shell 20 such that the valve stem 36 can pass between the annular surface 98 of the partition member 90. A valve stem bearing 106 is preferably positioned within the valve stem opening 104 and extends into the valve housing 14. The valve stem bearing 106 contacts the valve stem 36 when the valve stem 36 is moving upwardly and downwardly within the motor housing 12 to ensure accurate positioning of a valve poppet 132 in a valve seat 120.

The valve housing 14 is preferably positioned beneath the motor housing 12 and is secured thereto by a plurality of fasteners 108, such as bolts or the like, which are passed through the bottom portion 24 of the outer shell 20 and into the valve housing 14. The valve housing 14 includes a top surface 110, in communication with the motor housing 12, a bottom surface 112 in communication with an engine manifold, and an outer periphery 114. A gasket 134 is preferably positioned between the bottom portion 24 of the outer shell 20 and the valve housing 12 to reduce valve noise and vibration. The inclusion of the gasket 134 prevents any metal of the motor housing 12 from contacting any metal from the valve housing 14 and hinders the conductivity of heat and vibration. The only metal to metal contact between the motor housing 12 and the valve housing 14 is through the plurality of fasteners 108 that attach the motor housing 12 to the valve housing 14. The valve housing 14 includes an inlet passage 116, a valve opening 118 surrounded by the valve seat 120, a gas chamber 122, an exhaust opening 124, and an exhaust passage 126.

The valve stem 36 has an upper portion 128 that is partially telescopically received within the armature 30, and a lower portion 130 positioned within the valve housing 14. The lower portion 130 of the valve stem 36 has the poppet 132 formed thereon, for communication with the valve seat 120. The valve stem 36 is secured in the armature 30, through the valve stem opening 104 formed in the bottom portion 24 of the housing 20 and into contact with the valve seat 120. The valve stem bearing 106 is preferably positioned within the valve stem opening 104 and helps to accurately position the valve stem 36 and thus the poppet 132 with respect to the valve seat 120 as the valve opening 118 is being opened and closed. When the valve stem 36 is in a fully closed position or is being opened, the valve stem 36 contacts the valve stem bearing 106 to ensure accurate positioning thereof. The valve housing 14 is preferably formed of a metal casting. However, any other suitable material or manufacturing method may be utilized.

Figure 3:
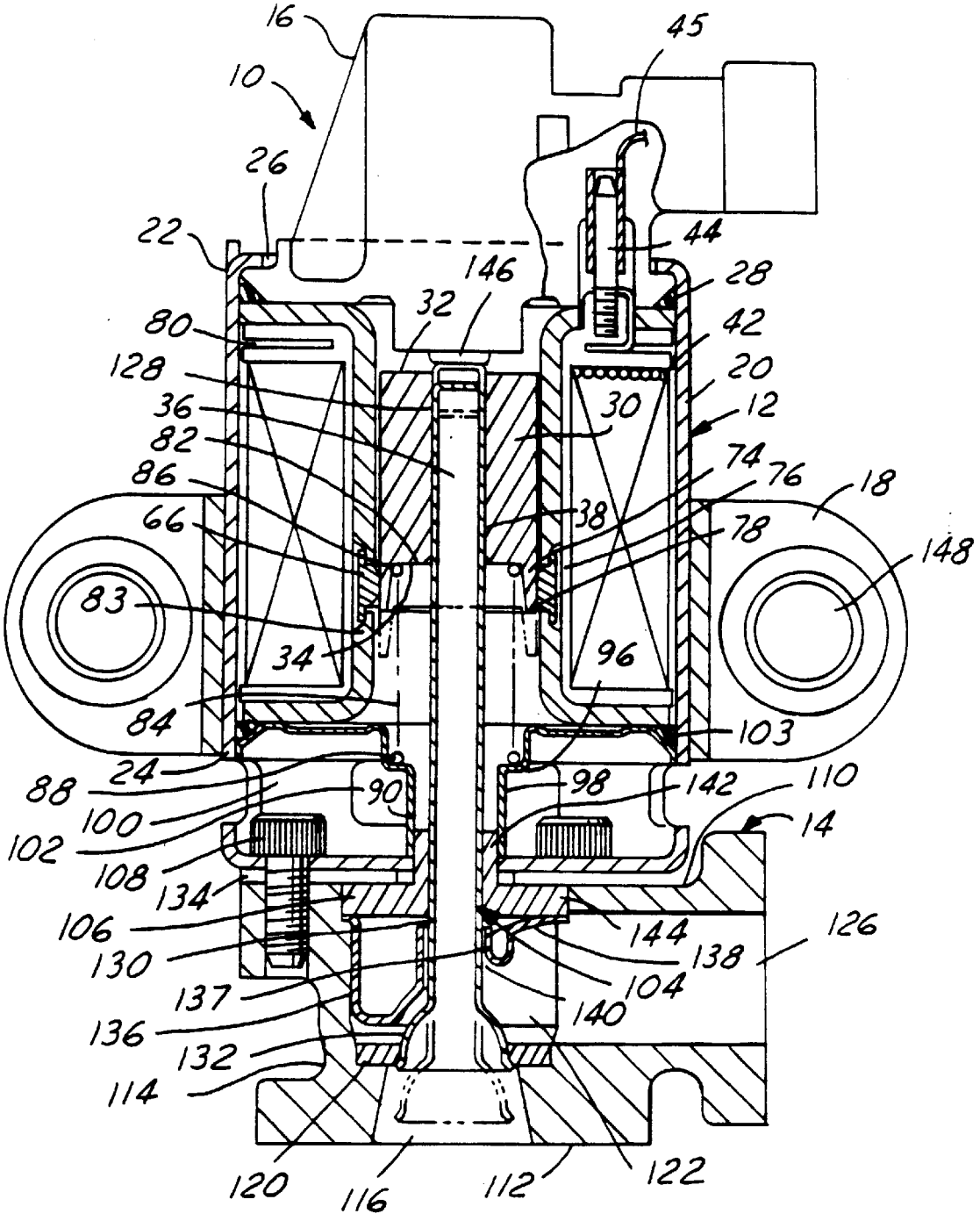
FIG. 3 is a cross-sectional view of an exhaust gas recirculation valve, including an engine mount, in accordance with another preferred embodiment of the present invention.

A stem shield 136 is preferably positioned within the valve housing 14. The stem shield 136 has a shoulder portion 138 that is preferably wedged between the valve stem bearing 106 and the valve housing 14. The stem shield 136 has a passageway 140 formed therethrough for passage of the valve stem 36. The stem shield 136 prevents contaminants in the exhaust gas that enter the gas chamber 122 through the inlet passage 116 from passing upward into communication with the valve stem bearing 106. The stem shield 136 may take on a variety of different configurations, depending upon the flow path of the valve, such as shown in FIGS. 1 and 3. For example, the stem shield 136 can guide the flow of exhaust gas through the valve, can improve its flow, can increase its flow and/or can direct the flow in a particular direction. The stem shield 136 also protects the valve stem bearing 106 and the valve stem 36 from contamination. In FIG. 3, the stem shield has ends 137 that are bent up into the passageway 140 to further restrict the flow of contaminants.

The valve stem bearing 106 has a generally vertical portion 142 and a generally horizontal portion 144. The generally vertical portion 142 passes through the valve stem opening 104 and contacts the annular surface 98 on one side and the valve stem 36 on its other side. The generally horizontal portion 144 contacts the gasket 134 on one side, the stem shield 136 on its other side, and the valve housing 14 around its periphery.

The sensor housing 16 includes a sensor plunger 146 which extends therefrom. The plunger 146 is designed to contact the closed upper end 37 of the hollow tube 35 which is secured within the bore 38 formed in the armature 30. The plunger 146 reciprocates upwardly and downwardly as the armature 30 and the valve stem 36 travel within the motor housing 12 due to current changes in the wire windings 42. The sensor housing 16 transmits current to the wire windings 42 through the terminal 44 based on signals from an external computer. The sensor housing 16 may be any commercially available sensor.

In operation, the EGR valve 10 receives exhaust gases from the engine exhaust transferred by the exhaust inlet passage 116 through the valve opening 118. The exhaust gas that passes through the valve opening 118 is then passed into the gas chamber 122 within the valve housing 14. As signals are received by the sensor housing 16, which indicate certain engine conditions, the current in the bobbin 40 is either increased or decreased to vary the strength of the magnetic field. When engine conditions indicate that the valve opening 118 should be opened, the wire windings 42 are excited with current through the terminal 44. The increased current in the bobbin 40 increases the strength of the magnetic force and causes the armature 30 to move downwardly within the motor housing 12 causing the poppet 132 to move away from the valve seat 120 thus opening the valve opening 118.

As the armature 30 is moved downwardly, the armature bearing 66 keeps the armature 30 axially and radially aligned in the motor housing 12. As the armature 30 moves downward, the valve stem 36, which is secured within the armature bore 38, also moves downwardly. During the downstroke, the valve stem 36 contacts the valve stem bearing 106. The valve stem 36 is illustrated in a closed position in FIG. 1 and in an open position in FIG. 2. The exhaust gas that passes to the gas chamber 122 then exits through the exhaust passage 126 to the intake system of a spark ignition internal combustion engine.

The sensor housing 16 is provided with the proper amount of current to allow the desired amount of exhaust gas through the valve opening 118 and back to the engine. The sensor housing 16 allows for closed loop control between the valve stem 36 and an associated ECU. This amount is predetermined depending upon the load and speed of the engine as is well known in the art. The sensor located within the sensor housing 16 also provides closed-loop feedback to assist in determining the position of the valve stem 36 and to regulate the amount of exhaust gas that flows through the valve opening 118. Upon transfer of the desired amount of exhaust gas through the valve 10 back to the engine, the current transmitted through the terminal 44 to the wire windings 42 decreases. The magnetic force is thus decreased allowing the armature 30 to return to its initial position by the biasing spring 84.

As the armature 30 and the valve stem 36 travel upwardly, the valve poppet 132 re-engages the valve seat 120 and closes off the flow of exhaust gas through the valve opening 118. As the valve stem 36 travels upwardly, the valve stem bearing 106 guides the valve stem 36 and keeps it accurately aligned to ensure proper closure of the valve opening 118. At the same time, the plunger 146 moves upwardly by the hollow tube 35 with which it is in contact to provide an indication of the position of the valve stem 36 with respect to the valve seat 120. Metering and controlling of the exhaust passage in this manner helps in reducing the engine's emissions of harmful oxides of nitrogen.

The engine mount 18 is preferably mounted to the engine block through a plurality of mount holes 148 by fasteners, such as bolts or the like. As shown in FIG. 1, in one embodiment, the engine mount 18 is attached to or incorporated into the valve housing 14. In another preferred embodiment, shown in FIG. 3, the engine mount 18 is incorporated into or otherwise attached to the motor housing 12. The embodiment shown in FIG. 3 allows the valve housing 12 to be further consolidated, therefore decreasing the size of the valve and reducing the cost of manufacture. It should be understood that various other configurations and attachment points may be incorporated into the engine mount 18.

Figure 4:
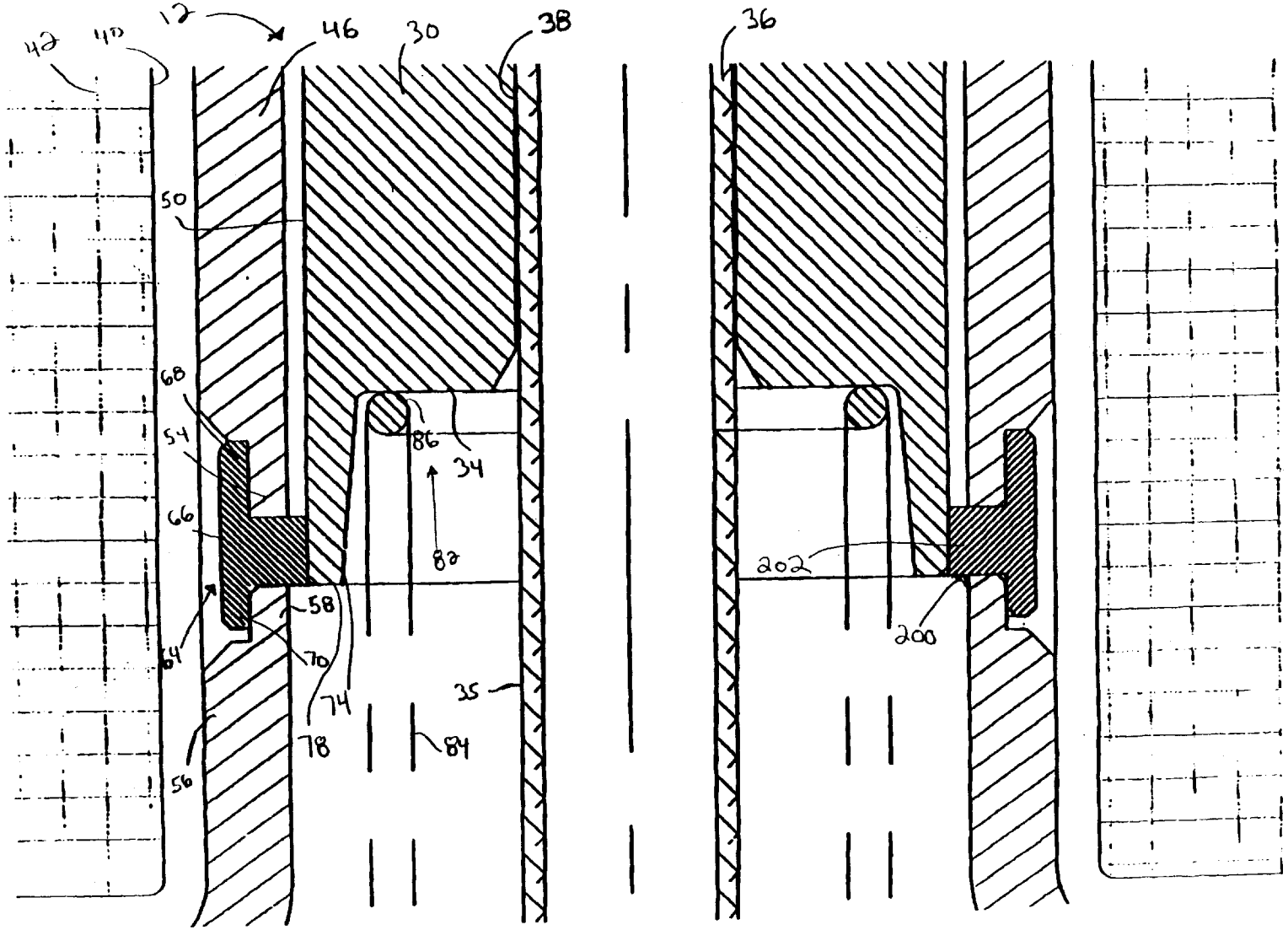
FIG. 4 is a cross-sectional view of a portion of an exhaust gas recirculation valve, in accordance with another preferred embodiment of the present invention.

Referring now to FIG. 4, which illustrates a cross-sectional view of another embodiment of a solenoid operated EGR valve 10. The embodiment of the valve 10 illustrated in FIG. 4 has many similar components to the valve shown in FIGS. 1 through 3 and thus, the identical components will be numbered the same in connection with the description of each embodiment. The differences between the embodiments lie in the configuration of the armature bearing 66.

As shown, the armature bearing 66 is disposed in the motor housing 12 to guide the armature 30 as it travels in response to increased and decreased current in the wire windings 42. The armature bearing 66 is positioned in the radial gap 64. The upper shoulder portion 68 of the armature bearing 66 is overlapped by the lower portion 54 of the flux return 46. The lower shoulder portion 70 of the armature bearing 66 is overlapped by the first portion 58 of the pole piece 56. The overlapping arrangement of the upper and lower shoulder portions 68, 70 securely positions the armature bearing 66 within the motor housing 12.

In the prior arrangement, as would be understood by one of skill in the art, the air gap 64 between the lower portion 54 of the flux return 46 and the first portion 58 of the pole piece 56 is large enough such that a magnetic circuit is created where flux travels from the flux return 46 through the armature 30 then through the pole piece 56. The armature 30 acts to bridge the air gap. However, in the preferred embodiment, the valve 10 is configured smaller to reduce cost as well as to decrease the size of envelope required to house the valve 10. Under certain operating conditions, the valve pintle will oscillate due to the input from pressure pulses of the engine exhaust valves. The oscillation becomes a control problem because the sensor signal is also oscillating. Because the engine computer cannot sample at high speeds to capture this oscillation properly, unstable conditions can result when PID control is used.

In accordance with the present invention, as shown in FIG. 4, the air gap 200 between the lower portion 54 of the flux return 46 and the first portion 58 of the pole piece 56 is reduced in size. The reduction preferably occurs by decreasing the size of the armature bearing 66. Preferably, the inner annular contact portion 202 is decreased in size. Additionally, the flux return 46 and the pole piece 56 are also lengthened in order to reduce the air gap 200. As shown in FIG. 4, only the flux return 46 was increased in length. By reducing the air gap 200, the flux path is changed. Some of the flux jumps directly from the flux return 46 to the pole piece 56. By shorting out some of the flux from traveling through the armature 30, the valve is prevented from dithering with respect to the valve seat. This configuration thus alters the magnetic circuit of the solenoid to induce electromagnetic damping, which eliminates valve dithering resulting from engine pressure pulsations. It should be understood that other apparatuses for reducing the air gap between the flux washer and pole piece may also be utilized.

Having now fully described the invention, it will be apparent to one of ordinary skill in the art that many changes and modifications can be made thereto without departing from the spirit or scope of the invention as set forth herein.

What is claimed is:

1. An exhaust gas recirculation valve (10) for an engine including a valve housing (14), a motor housing (12), and a sensor housing (16), comprising:

an armature (30) disposed in the motor housing (12), said armature (30) being moveable so as to cause a valve (10) to move into and out of contact with a valve seat (120);

an armature (30) bearing disposed in said motor housing (12) and positioned to contact the outer periphery of said armature (30);

a flux return (46) having an end (54) in communication with an upper portion (68) of said armature bearing (66);

a pole piece (56) having an end (58) in communication with a lower portion (70) of said armature bearing (66);

wherein one of said end (54) of said flux return (46) or said end (58) of said pole piece (56) are located so as to reduce an air gap (200) therebetween to cause magnetic shorting therebetween.

2. The valve of claim 1, wherein electromechanical damping is induced into the system.

3. The valve of claim 1, wherein both said end (54) of said flux return (46) and said end (58) of said pole piece (56) are lengthened in order to reduce said air gap.

4. A method for reducing dithering in a solenoid exhaust gas recirculation valve (10), having a valve housing (14), a motor housing (12), and a sensor housing (16), comprising:

providing a duty cycle signal to the valve (10) from an engine computer to open the valve (10) an amount proportional to said duty cycle;

sensing the amount of exhaust gas flowing through said open valve to an intake manifold;

providing a feedback signal to said engine computer in order to accurately control the position of the valve (10); and inducing electromechanical damping into the valve to reduce oscillation of the valve.

5. The method of claim 4, further comprising:

reducing an air gap (200) between a flux return (46) and a pole piece (56).

6. The method of claim 4, further comprising:

reducing an air gap (200) between a flux return (46) and a pole piece (56) by lengthening one of said flux return (46) or said pole piece (56) to cause a short therebetween.

7. The method of claim 6, further comprising increasing the length of each of said flux return and said pole piece (156) in order to reduce said air gap (200).

8. An exhaust gas recirculation valve for an engine, comprising:

a valve housing (14), including a valve inlet adapted to receive exhaust gas, a valve seat surrounding a valve opening, through which said received exhaust gas passes, and a valve outlet adapted to communicate said received exhaust gas to an engine intake;

a motor housing (12) having disposed therein a solenoid coil, an armature (30), and a valve stem in communication with said armature (30) and linearly moveable so as to open and close the communication between said valve inlet and said engine intake;

a sensor housing (16) having an electromagnetic mechanism therein to monitor the position of said valve stem and thus said armature;

a guide bearing (66) disposed within said motor housing and in communication with an outside surface of said armature to accurately position said armature concentrically within said motor housing;

a flux return (46) in communication with said guide bearing (66) at an upper surface;

a pole piece (56) in communication with said guide bearing (66) at a lower surface; and an air gap (200) formed between said flux return (46) and said pole piece (56) which is sized to cause electromechanical damping therebetween.

* * * * *